United States Patent [19]

Shirai et al.

[11] Patent Number: 4,645,441

[45] Date of Patent: Feb. 24, 1987

[54] INTERNAL-GEAR PUMP WITH PARTITION PLATE HAVING A CHAMFERED EDGE

[75] Inventors: Ryoichi Shirai, Okazaki; Fumitomo Yokoyama, Anjo; Koujiro Kuramochi, Okazaki, all of Japan

[73] Assignees: Aisin-Warner Limited, Anjo; Toyota Motor Corporation, Toyota, both of Japan

[21] Appl. No.: 719,013

[22] Filed: Apr. 2, 1985

[30] Foreign Application Priority Data

Apr. 12, 1984 [JP] Japan ..... 59-74463

[51] Int. Cl.[4] ..... F04C 2/10

[52] U.S. Cl. ..... 418/126; 418/170

[58] Field of Search ..... 418/126, 169, 170

[56] References Cited

U.S. PATENT DOCUMENTS 3,679,335 7/1972 Zippel et al. ..... 418/170

FOREIGN PATENT DOCUMENTS 2641278 3/1978 Fed. Rep. of Germany ..... 418/126
3141682 5/1983 Fed. Rep. of Germany ..... 418/170
291208 12/1931 Italy ..... 418/169

*Primary Examiner*—John J. Vrablik
*Attorney, Agent, or Firm*—Pahl, Lorusso & Loud

[57] ABSTRACT

An internal-gear pump with a partition plate, comprising: an arcuate chamfer formed at an inner edge of an end face of the partition plate rotationally opposing an inner gear of the pump and having a curvature at least greater than that of tooth tip edges of the inner gear.

4 Claims, 7 Drawing Figures

INTERNAL-GEAR PUMP WITH PARTITION PLATE HAVING A CHAMFERED EDGE

BACKGROUND OF THE INVENTION (i) Field of the Invention

This invention relates to an internal or inscribing type gear pump with a partition plate, which has improved durability at high speed rotation.

(ii) Description of the Prior Art

The internal gear pumps which are incorporated into fluid couplings of motor vehicles for supply of pressurized oil receive strong impacts at the tooth tips of an inner gear due to interference impacts which take place between the tooth tips and an inner edge of an end face of the partition plate as a result of abrasive wear of rotational shafts or the like, lowering durability considerably, particularly in the case of high speed engines which are widely used these days. In order to avoid this problem, it has been the general practice to provide a greater clearance at the tooth top, but such a measure naturally invites drops in pumping capacity. If the tooth width is increased as a countermeasure, the pump requires a greater driving torque which is disadvantageous in view of the uneconomical mileage which would result.

SUMMARY OF THE INVENTION

It is therefore an object of the present invention to provide an internal-gear pump with a partition plate, which is constructed to endure sufficiently the impact forces which may be caused by interference impacts between edge portions of the partition plate and tooth tips of the gear after high speed operation over a long period of time.

According to the present invention, there is provided an internal-gear pump with a partition plate, comprising:

an arcuate chamfer formed at an inner edge of an end face of the partition plate rotationally opposing an inner gear of the pump and having a curvature at least greater than that of tooth tip edges of the inner gear.

The internal-gear pump with the above-described construction according to the invention has a number of advantageous effects as follows.

(a) The internal-gear pump of the invention can eliminate the problem of the conventional gear type oil pumps which are incorporated into automatic transmissions of motor vehicles with high-speed engines, i.e., the problem that the function of an automatic transmission is lowered by degradation of the pump function.

(b) The measure of increasing the clearance at the gear tooth top for prevention of interference impacts between a partition plate and tooth tips is unnecessary to avoid degradation in the performance quality of the pump.

(c) The pump of the invention avoids the problem of uneconomical mileage as caused by an increase in pump driving torque when a drop in pumping capacity due to an increase of the tooth top clearance is compensated for by an increase of tooth width.

(d) The partition plate is same as its conventional counterpart in fundamental shape and needs only a localized chamfering operation in the machining stage, so that the present invention can lengthen the service life of the pump to a significant degree, without incurring much expense.

The above and other objects, features and advantages of the invention will become apparent from the following description and appended claims, taken in conjunction with the accompanying drawings which show by way of example preferred embodiments of the invention.

DESCRIPTION OF PREFERRED EMBODIMENTS

Figure 1:
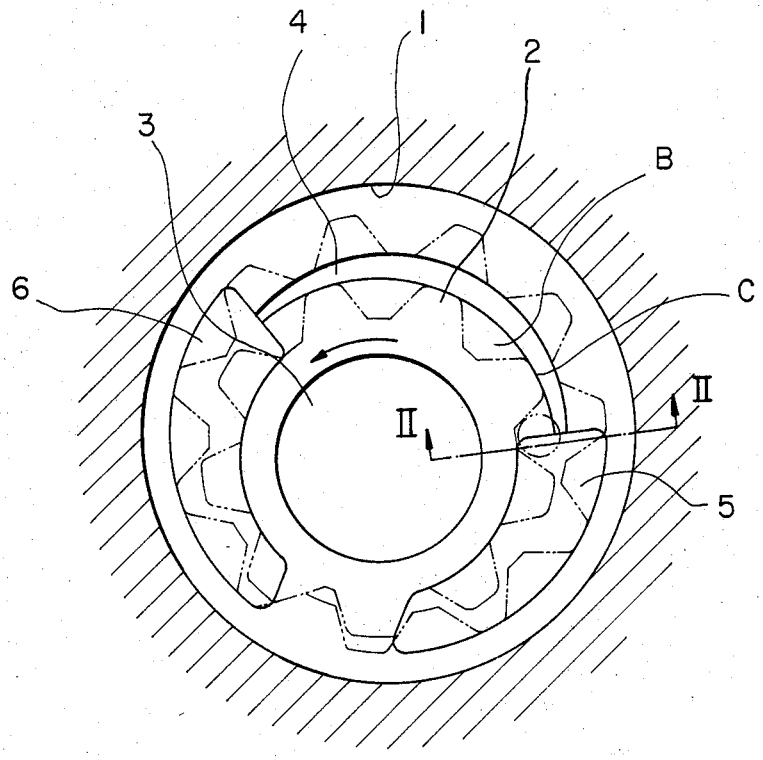
FIG. 1 is a schematic plan view of an internal-gear pump according to the invention, showing its major component parts.
Figure 2:
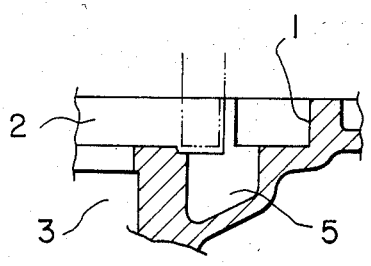
FIG. 2 is a sectional view taken on line II—II of FIG. 1.

Referring to FIG. 1, there is illustrated an internal-gear pump with a partition plate, embodying the present invention, in which denoted at 1 is an inner wall of the pump housing, at 2 an inner gear, at 16 an outer gear, at 3 a rotational shaft of the inner gear 2, at 4 a partition plate interposed between inner and outer gears, at 5 a fluid inlet and at 6 a fluid outlet.

In the gear pump of the above-described construction, a fluid which is confined in spaces B between the partition plate 4 and inner gear 2 is quickly moved from the inlet 5 to the outlet 6 when the inner and outer gears form only a small gap with the inner and outer curved surfaces of the partition plate 4 (in the form of a curved plate with a crescent shape in plan view), thereby sending the fluid to the outlet 6 under pressure. The clearance C (tooth top clearance) between the inner gear 2 and partition plate 4 is required to be as small as possible without causing contact between the tooth top and partition plate 4, for the purpose of maintaining a high pumping capacity by holding to a minimum the amount of fluid which tends to leak out of the spaces B upon pressurization and to flow back toward the inlet 5.

However, a gear pump with a partition plate, which is driven from an engine to supply a high oil pressure as an operating medium to an automatic transmission of a motor vehicle, undergoes accelerating abrasive wear especially in its rotational shaft portion in high speed type engines. Therefore, coupled with abnormal vibrations in some cases, the tooth top clearance which is initially set at a small value approaches zero and finally an interference gap is formed between the tip ends of teeth of the inner gear 2 and an inner edge portion of the end face of the partition plate 4 which rotationally opposes the inner gear 2, with the possibility of destroying the gear by impact in a worse case.

Figure 3:
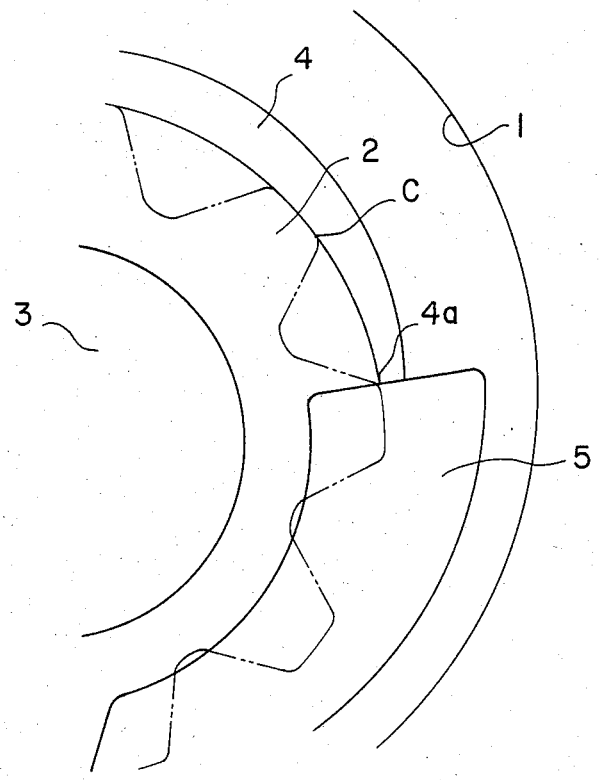
FIG. 3 (PRIOR ART)
FIG. 3 is an enlarged fragmentary view of a conventional internal-gear pump showing the position where a rotating gear approaches a partition plate.

The partition plate which is used in the conventional internal-gear pump has its end edge portion 4*a* formed in an acute angle almost a right angle, as shown in FIG. 3 which illustrates the area around the fluid inlet 5 of the pump on an enlarged scale. Accordingly, if interference impacts occur between the tips of the gear teeth and the end edge portion 4*a*, an extremely large impact stress is imposed per unit area of a tip end of each gear tooth since the contact area is very small and the gear is rotated at a high speed, giving rise to a problem of safety.

Figure 4:
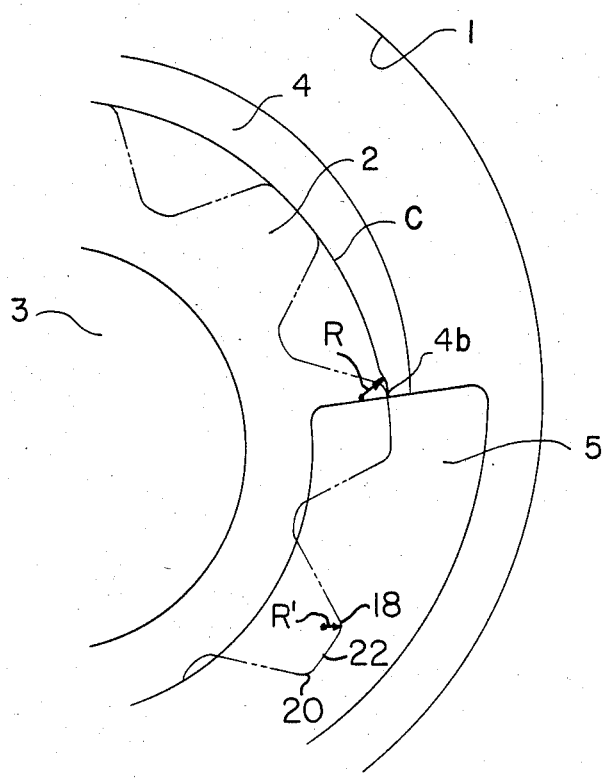
FIGS. 4 and 5 are views similar to FIG. 3 but showing the internal-gear pump according to the invention.

In the first embodiment illustrated for the internal-gear pump with a partition plate according to present invention, this problem is solved by chamfering the partition plate 4 at the inner edge of its end face which rotationally opposes the inner gear 2, arcuately in a concave shape as indicated at 4*b* of FIG. 4. By chamfering the inner edge of the partition plate 4 in this manner, the contact area between a tooth tip and the inner edge portion of the partition plate is suitably broadened even in the case of an interference impact therebetween, as compared with the partition plate 4 shown in FIG. 3. Consequently, the impact force per unit area of the contacting portion at the tip of each gear tooth is reduced to a considerable degree, precluding the possibility of gear destruction.

As indicated in FIG. 4, each tooth on the inner gear 2 has a tip portion defined by curved edges 18 and 20 with a radius of curvature "R'" and a top face 22. The curvature of the arc R of the concavely chamfered surface is preferred to be at least two times greater than that (R') of the tip edge of the gear tooth to provide a broad contact area. However, a curvature which is more than ten and several times greater than that of the tooth tip is undesirable since it would unduly broaden the tooth top clearance C over a substantial distance along the inner side of the partition plate 4.

Figure 5:
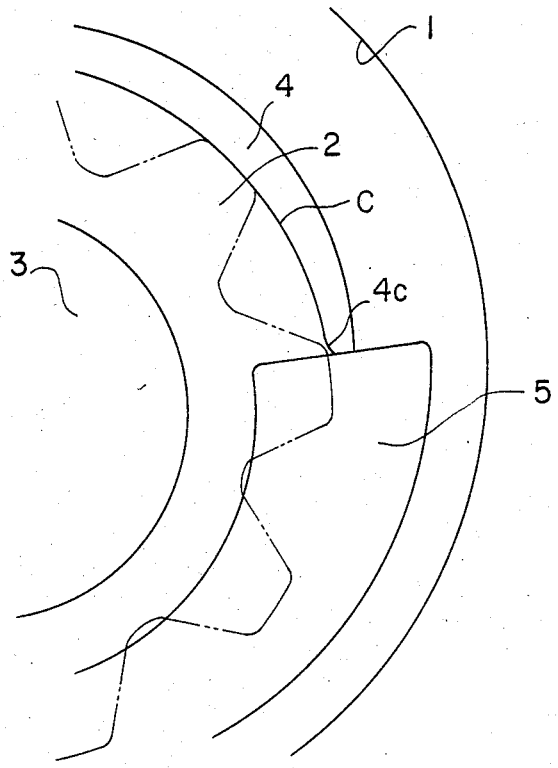

Referring to FIG. 5, there is shown a second embodiment of the invention, in which the inner edge portion 4*c* of the partition plate 4 is arcuately rounded off. In this case, the curvature of the arc is preferred to be more than two times greater than that of the tooth tip.

The chamfered surface at the inner edge of the partition plate is not necessarily restricted to the above-described shapes and may consist of a combination of a flat surface and a curved surface or a combination of two or more curved surfaces of different curvatures. What is important here is to shape the inner edge of the partition plate such that, when the gear and partition plate are forced into collision against each other, the contact surfaces of the two parts are gradually drawn nearer and engaged with each other over relatively broad areas.

Figure 6:
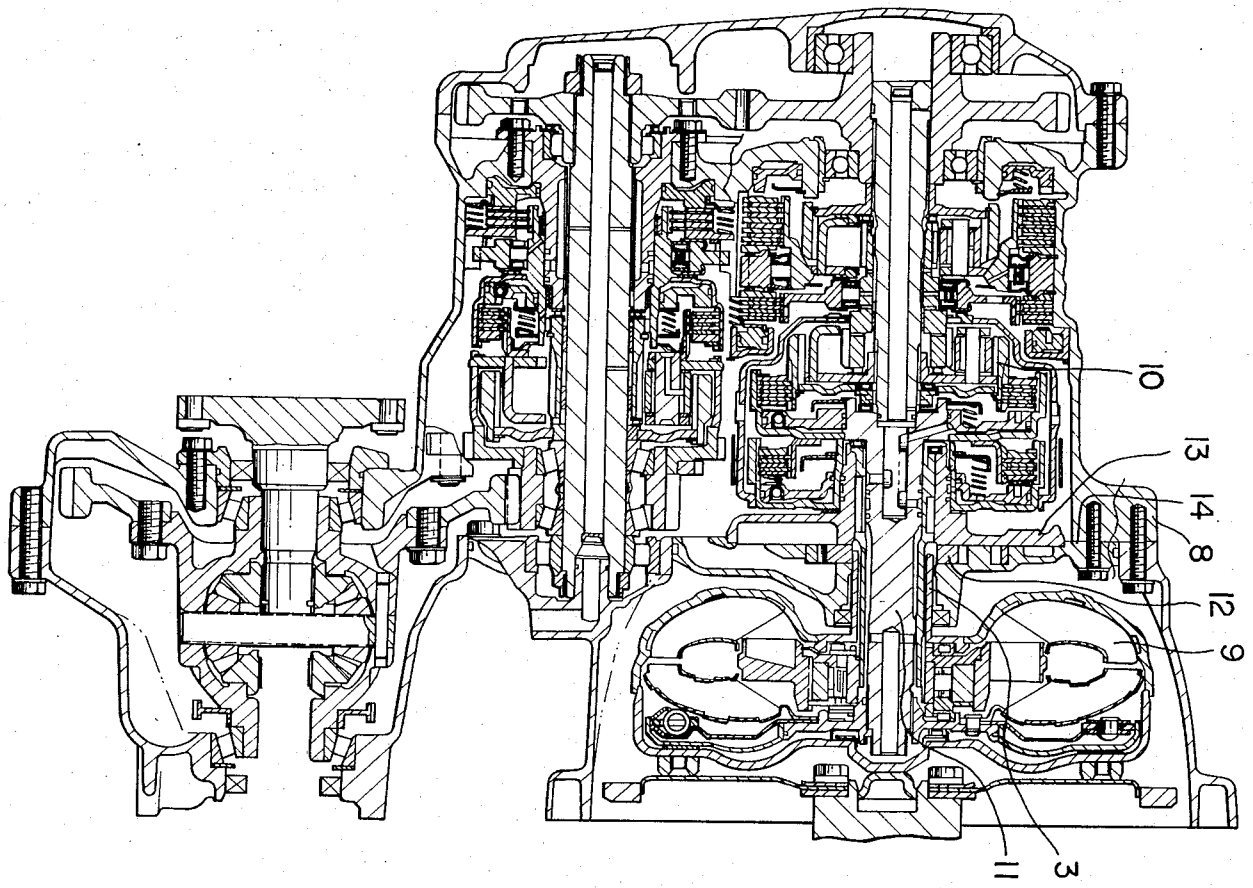
FIG. 6 is a vertical section of an automatic transmission of a motor vehicle incorporating the gear pump of the invention.
Figure 7:
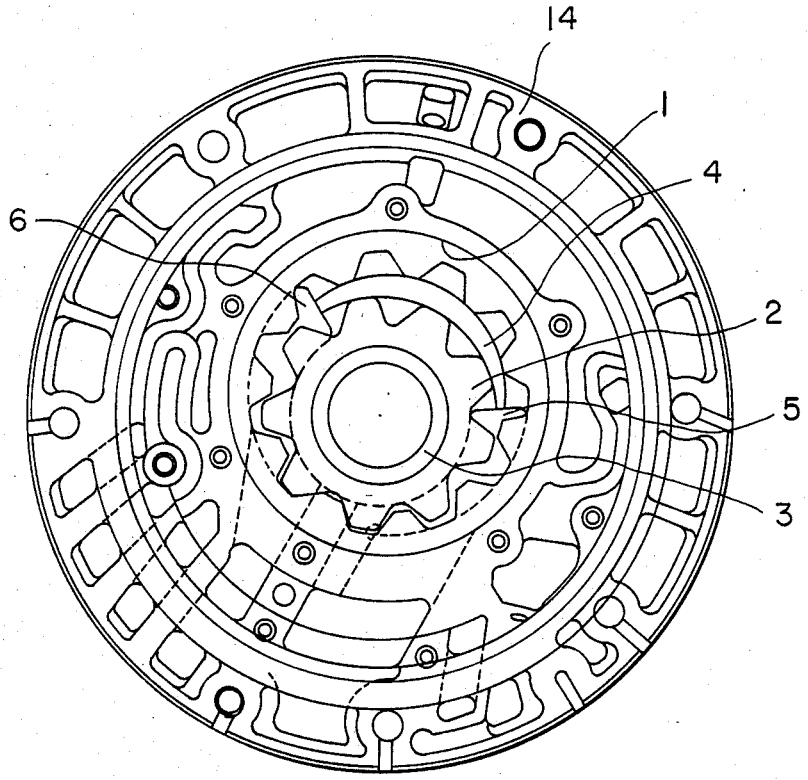
FIG. 7 is a schematic plan view of the gear-pump mounted in position on the transmission, with one side of the pump housing being removed for the convenience of illustration.

Illustrated in FIGS. 6 and 7 is an example of a vehicular automatic transmission incorporating the internal-gear pump with a partition plate according to the present invention. In these figures, denoted at 8 is housing of the automatic transmission, at 9 is a fluid coupling, at 10 is a transmission gear mechanism, at 11 is an input shaft of the transmission, and at 12 is a pump gear, and at 13 and 14 are split type pump housings.

What is claimed is:

1. A gear pump comprising:

a pump housing having a pump chamber, a fluid inlet and a fluid outlet;

an outer gear mounted for rotation within said pump chamber and having a first plurality of teeth on its inner surface;

an inner gear mounted in said pump chamber and inside of said outer gear, said inner gear being mounted for rotation about an axis off center with respect to said outer gear to define a generally crescent shaped space therebetween, said inner gear having, extending from its outer surface, a second plurality of teeth which mesh with said first plurality of teeth through a given angle of rotation, said first plurality of teeth being about two in number more than said second plurality of teeth, each tooth of said second plurality having a tip with curved edges and a top face extending therebetween; and a crescent shaped partition plate integral with said housing and substantially filling said crescent shaped space, said partition plate having a convex outer surface, a concave inner surface and a flat end face adjacent said fluid inlet, said end face being a substantially radially extending surface joining said convex and concave surface, said end face and said concave inner surface meeting at an edge parallel to said axis, said edge having a machined chamfer for reducing the force per unit area of any impact between said second plurality of teeth and said concave surface, said chamfer having a radius of curvature greater than that of the edges of said second plurality of teeth and the circumferentially extending width of said chamfer being substantially less than the circumferentially extending width of said top face.

2. A gear pump in accordance with claim 1 wherein said chamfer is concave.

3. A gear pump in accordance with claim 1 wherein said radius of curvature of said chamber is at least two times the radius of curvature of the edges of said second plurality of teeth.

4. A gear pump in accordance with claim 2 wherein said radius of curvature of said chamfer is at least two times the radius of curvature of the edges of said second plurality of teeth.

* * * * *